US008591150B2

(12) United States Patent
Hagen

(10) Patent No.: US 8,591,150 B2
(45) Date of Patent: Nov. 26, 2013

(54) RDX PLANT INDICATOR SYSTEM

(76) Inventor: Frank Hagen, Pleasant Plains, IL (US)

( * ) Notice: Subject to any disclaimer, the term of this patent is extended or adjusted under 35 U.S.C. 154(b) by 231 days.

(21) Appl. No.: 13/309,534

(22) Filed: Dec. 1, 2011

(65) Prior Publication Data

US 2012/0141209 A1 Jun. 7, 2012

Related U.S. Application Data

(60) Provisional application No. 61/418,729, filed on Dec. 1, 2010.

(51) Int. Cl.
*B09C 1/00* (2006.01)
*G06K 9/00* (2006.01)

(52) U.S. Cl.
USPC ..... 405/128.1; 382/110

(58) Field of Classification Search
USPC ..... 382/110; 405/128.1, 128.7, 128.15
See application file for complete search history.

(56) References Cited

U.S. PATENT DOCUMENTS 6,160,902 A * 12/2000 Dickson et al. ..... 382/110
6,366,681 B1 * 4/2002 Hutchins ..... 382/110
2001/0016053 A1 * 8/2001 Dickson et al. ..... 382/110
2008/0304711 A1 * 12/2008 Scharf et al. ..... 382/110

OTHER PUBLICATIONS

Best, et al. Capacities of Candidate Herbaceous Plants for Phytoremediation of Soil-based TNT and RDX on Ranges 2008.*

* cited by examiner

*Primary Examiner* — John Kreck
(74) *Attorney, Agent, or Firm* — Richards Patent Law P.C.

(57) ABSTRACT

A method of detecting RDX in soil includes the steps of: planting a plurality of prickly sida plants in a defined area; remotely monitoring the pigmentation of the prickly sida plants using hyperspectral imaging; and identifying one or more areas within the defined area that are contaminated by RDX based on the monitored pigmentation of the prickly sida plants.

6 Claims, 4 Drawing Sheets

RDX PLANT INDICATOR SYSTEM

CROSS-REFERENCE TO RELATED APPLICATIONS

This application incorporates by reference and claims priority to U.S. Provisional Patent Application No. 61/418,729 filed Dec. 1, 2010.

BACKGROUND OF THE INVENTION

The present subject matter relates generally to a RDX plant indicator system. More specifically, the present invention relates to a plant indicator system designed to detect contamination of RDX using prickly sida plants as sentinels.

The continuous use of explosives on training ranges results in the development of major negative environmental impacts that are difficult to remedy. Also, the costs of environmental compliance, cleanup, pollution reduction, and conservation are significant. Existing methods to test for contamination are also dangerous since the military sites may include land mines and other explosives or explosive residues. Hexahydro-1,3,5-trinitro-1,3,5-triazine, referred to as RDX, is commonly found at military operation sites. RDX is one of the most widely distributed energetic soil contaminants. RDX is the primary energetic used in most military applications from explosives ordnance (bombs, missiles, and shells) to missile propellants and demolition charges. The United States Department of Defense (DoD) has identified more than one thousand sites with explosives contamination. Many sites became contaminated through open detonation and burning of explosives at army depots, evaluation facilities, artillery ranges, and ordnance disposal sites. Before the 1980's, waste was often dumped in unlined pits, and has now contaminated both soil and groundwater. The use of ordnance continues to pollute soil and water in the U.S. and worldwide.

As RDX readily migrates into the surface or near surface soils, it leads to soil and groundwater contamination. Soil contamination by this energetic at military ranges in the United States and Canada is well documented. Furthermore these contaminants have leached into and contaminated groundwater. Their residues are known to accumulate in soils on military ranges. Live fire training and testing ranges are placed at risk by the transport of Off Range Contaminates (ORC) through a variety of environmental pathways.

The mobility of energetic residues is a major concern. Mobility is a complex process and has many confounded effects. Among energetics, TNT and RDX are most widely distributed as soil contaminants, and both compounds are often found in the soil at the same site. RDX has a high potential for soil leaching since it does not bind to soil very strongly and can move rapidly into the groundwater. RDX is more soluble than other contaminants, but RDX is not typically absorbed or biodegraded significantly in aerobic soil. Unlike TNT, RDX does not bind to soil particles, and its breakdown products are more likely to move into the groundwater. Energetics and residues are labile in the environment and these changes can be caused through sunlight, soil microbes, and transformation by certain plant processes.

RDX does not bioaccumulate or build up in fish or people, but exposure to RDX in large amounts may cause seizures. However, the effects of long-term, low-level exposure to RDX in humans is unknown. Studies have also been made on plants and crops, and many plants have developed an uptake of RDX from contaminated soil and contaminated irrigation water. Technologies such as phytoextraction and phytostabilization has been studied in cases of TNT contamination.

Phytoextraction is the use of plants to uptake, accumulate, and remove contaminants from the soil, and phytostabilization is the use of both plants and soil amendments to prevent the contaminants from moving out of the area. These methods may be used to detect contamination on military sites.

A large number of studies have been done to evaluate phytoremediation processes for energetics. However, in the studies using plants, the majority of plants are either grasses or species growing in wetland habitats. Little research has been on upland plants. Past research has focused mainly on grasses and found RDX induced inhibition of biomass production. Also, related work has been done where fluorescence was used as an indicator in monitoring uptake of explosives in genetically modified plants that were not commonly found on ranges. This approach may be more expensive, and does not provide a realistic training environment on ranges.

Also, in order to test for contamination on military sites, the safety of range personnel is often compromised in order to collect field samples and test for energetics. In areas with dense vegetation, locations of residues are more difficult to visualize and locate. Collecting these samples also disrupt military range activity and put personnel in danger since they may disrupt an unexploded land mine or other explosive. The current methods of collecting sufficient data for a comprehensive environmental assessment are also very costly.

Therefore, there is much concern regarding the migration of these contaminants, particularly RDX, to groundwater. Ecosystem components, such as vegetation cover and soil types, play important roles in determining potential pathways a contaminant may take upon leaving a particular range.

Accordingly, a need exists for a plant indicator system designed to detect contamination of RDX using naturally occurring plants such as prickly sida as sentinels as described and claimed herein.

BRIEF SUMMARY OF THE INVENTION

The plant indicator system detects contamination of RDX using prickly sida plants as plant sentinels. When exposed to RDX, the prickly sida plants may respond by having pigmentation discoloration that may be observed using remote hyperspectral imaging.

Possible movement pathways of contaminants can be determined through soil leaching and plant uptake. The energetic interaction and other environmental factors stress the plants and may often result in physiological changes, such as stunting and pigmentation discoloration. For example, when the prickly sida plants detect contaminants, their leaves may turn red. While some of the changes are visible to the naked eye, detection by hyperspectral imaging is more efficient, safe, and cost effective.

Using plants that grow in the natural range ecosystem to detect these contaminants is beneficial to military ranges as plants are relatively inexpensive. If additional plants are needed on a range they may be planted safely by air seeding or hydro seeding methods over an un-cleared range area. The use of vegetation as sentinels to indicate the presence and/or absence of contaminants may also provide an ideal mechanism for detecting contaminants in a large area. Additionally, forbs and grasses such as the prickly sida plant are commonly maintained on active firing ranges since they provide a realistic training environment and control erosion.

Color changes have been observed in a species of plant belonging to the Malvaceae family, Prickly Sida (*Sida spinosa*). This particular member of the Malvaceae family is known to grow well throughout the United States. These plants were one of five species grown in a typical soil from a large military base that had been treated with TNT or RDX soil. Prickly Sida was the only plant that became red in the presence of RDX in the soil. This plant also exhibited interveinal chlorosis and a reduction in biomass and fruit size. The red color change was visible in the leaf margins and not in the same area as the interveinal chlorosis. The red pigment appeared on the top leaf surface. Red coloration may be caused by anthocyanins, which are produced in response to free radicals. When a sida uptakes RDX it triggers an antioxidant reaction in the leaves thus activating the gene expression to up regulate the enzymes involved in the Shimikic pathway leading to production of anthocyanin.

Prickly sida is also resilient to RDX contamination. Resilience to physical disturbance and tolerance towards contaminants such as energetics are important determinants in the distribution of plants at contaminated training areas. Resilience is the ability of a vegetative system to recover after disturbance and return to its original state. Military training exercises often destroy the vegetation, which leads to soil erosion, increased runoff, and leaching of explosives. Since prickly sida exhibits resilience to RDX, it is an ideal plant to be used to detect contamination.

The method of using plant sentinels to detect soil contaminated with RDX includes the first step of planting the prickly sida plants by air seeding or hydro seeding in a desired operational range or military site where RDX is used. This allows for safe delivery of the plants to the site. The second step is to remotely monitor the prickly sida plants using hyperspectral imaging. The third step is to detect and monitor any appearance of color changes on the leaves of the prickly sida plants indicating soil contaminated with RDX. The fourth step is to use intensity signals of chlorophyll fluorescence to determine the sensitivity of frequency disruption, or days required to observe a response, of the prickly sida plants to RDX. The fifth step is to use spectral measurements to distinguish the appearance of color changes from contamination or any natural stressors. It is necessary to discern that the color change in the prickly sida, if producible, is not caused by any environmental stressors. Stressors such as drought, soil salinity, pH changes, nutrients, and soil type have been evaluated to ensure they have not produced false positives.

The sixth step is to determine which parts of the operational range or surrounding areas are contaminated based on which prickly sida plants have red leaves. Remote hyperspectral imaging is used to detect any red leaves on the prickly sida plants. This imaging may inform personnel of the exact location of the red prickly sida plants. Non-invasive remote sensing technologies, such as chlorophyll fluorescence, is used to monitor plant stress and to detect and predict changes in the natural environment. The visible and hyperspectral response to energetics in plants could improve the environmental sustainability of military firing ranges. With this technology, the safety of range personnel would not be endangered by a successful operating remote sensing protocol. The use of remote sensing technology may lower costs of collecting sufficient data for comprehensive environmental assessment and may increase safety since data may not have to be collected by range personnel. Finally, the seventh and final step allows for treatment of the contaminated area.

In one example, a method of detecting RDX in soil includes the steps of: planting a plurality of prickly sida plants in a defined area; remotely monitoring the pigmentation of the prickly sida plants using hyperspectral imaging; and identifying one or more areas within the defined area that are contaminated by RDX based on the monitored pigmentation of the prickly sida plants. The step of planting the prickly sida plants may be accomplished by an air seeding or hydro seeding process. The step of remotely monitoring the pigmentation of the prickly sida plants may include monitoring the intensity signals of chlorophyll fluorescence in the plants. Further, the step of remotely monitoring the pigmentation of the prickly sida plants may include using spectral measurements to distinguish the appearance of color changes in response to RDX as opposed to color changes in response to natural conditions. The method may further include the step of treating the identified contaminated areas to remove the RDX contamination.

An essential DoD priority includes remote sensing technologies to identify off site contaminant migration without interfering in range activity. Non-invasive remote sensing technologies, such as chlorophyll fluorescence, is used to monitor plant stress and to detect and predict changes in the natural environment. The visible and hyperspectral response to energetics in plants could improve the environmental sustainability of military firing ranges. With this technology, the safety of range personnel would not be endangered by a successful operating remote sensing protocol.

An advantage of the plant indicator system is that it may indicate when soil is contaminated with RDX.

Another advantage of the plant indicator system is that it may allow for remote detection of RDX contamination using hyperspectral imaging.

A further advantage of the plant indicator system is that it allows for safe detection of contaminants on military sites.

Yet another advantage of the plant indicator system is that it uses plants that are naturally occurring.

Another advantage of the plant indicator system is that it uses low cost hyperspectral imaging.

Additional objects, advantages and novel features of the examples will be set forth in part in the description which follows, and in part will become apparent to those skilled in the art upon examination of the following description and the accompanying drawings or may be learned by production or operation of the examples. The objects and advantages of the concepts may be realized and attained by means of the methodologies, instrumentalities and combinations particularly pointed out in the appended claims.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION OF THE INVENTION

Figure 1:
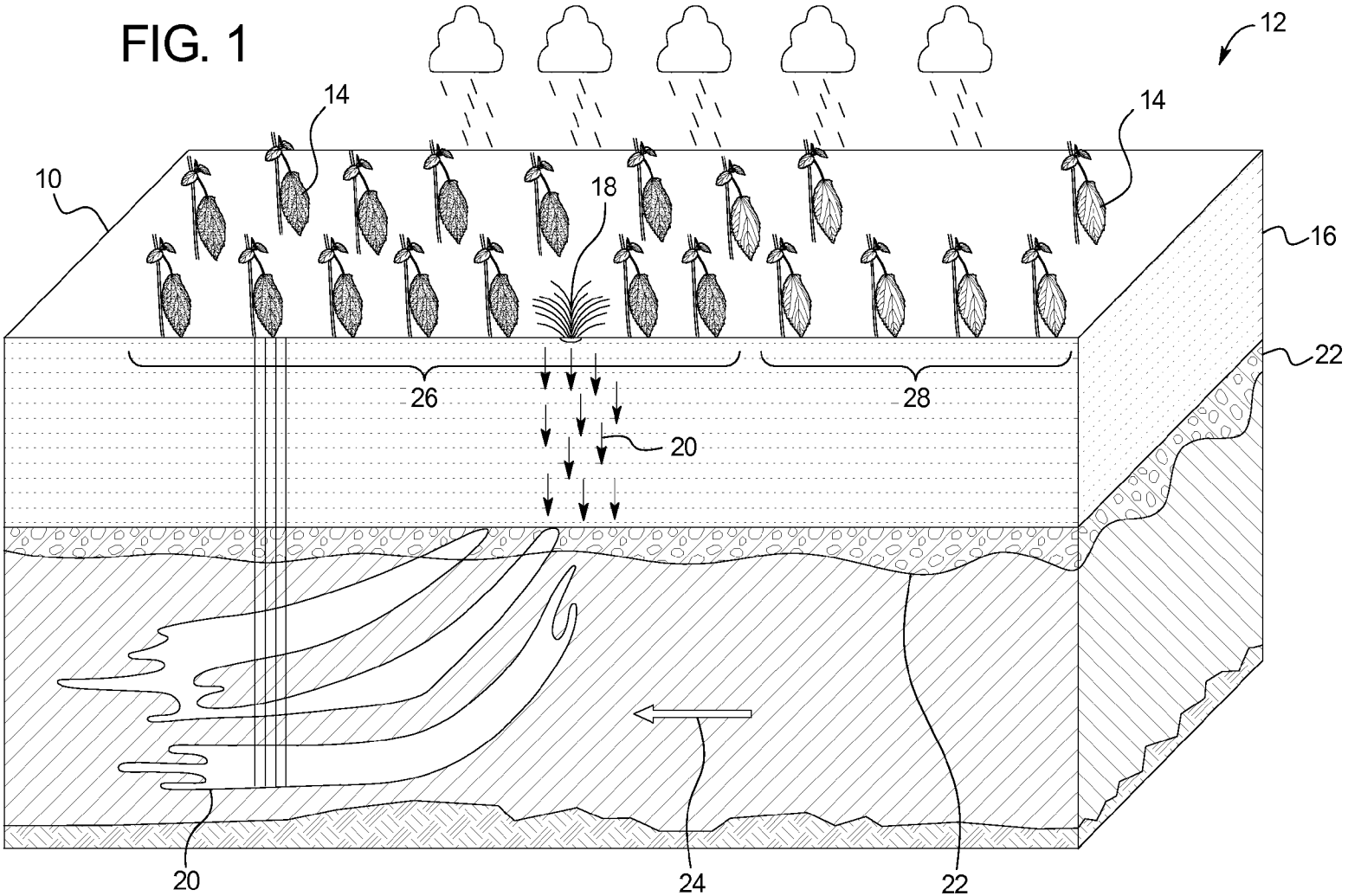
FIG. 1 is a contaminant transport model illustrating how prickly sida plants respond to contaminants, such as RDX, in the soil.

FIG. 1 illustrates an example of a contaminant transport model 12 illustrating how prickly sida plants 14 respond to contaminants, such as RDX, in the location. As shown in FIG. 1, the plant indicator system 10 (hereinafter "the system") includes a plurality of prickly sida plants 14 spread over an area of soil 16 to detect the presence of a contaminant at the site. In one example, an explosive 18, such as RDX (Hexahydro-1,3,5-trinitro-1,3,5-triazine), may be detonated on the ground surface of the soil 16 causing explosive residue 20 to seep into the site, particularly when there is precipitation that assists in transporting the contaminant through the soil 16 and into the groundwater mixing zone 22.

As shown in FIG. 1, after the explosive 18 has been detonated, the explosive residue 20 seeps through the soil 16 and enters the groundwater mixing zone 22. In the example in FIG. 1, the groundwater carries the explosive residue 20 in the direction of the groundwater flow 24.

In order to detect the presence of the contaminant in the soil 16, the plants 14 are spread over the ground surface of the soil 16. For example, the plants 14 may be planted by air seeding or hydro seeding such that the ground surface of the soil 16 is reasonably well covered by the plants 14.

In the example used in FIG. 1, the plant indicator system 10 detects contamination of RDX 18 using prickly sida plants 14 as plant sentinels. When the prickly sida plant (i.e., a species of plant belonging to the Malvaceae family, Prickly Sida, *Sida spinosa*) 14 is exposed to RDX 18, color changes in the plant 14 are visually observable. Specifically, when exposed to RDX 18, the normally green leaves of the prickly sida plants 14 (shown in FIG. 3A) respond by exhibiting a red pigmentation discoloration 60 (shown in FIG. 3B). The red pigmentation discoloration 60 appears only on the top leaf surface and not the under leaf. The red pigment discoloration 60 may be observed using remote hyperspectral imaging, which enables the detection of the contamination from a safer location rather than requiring direct contact with the contaminated area. While the pigment changes shown in FIG. 1 may be visible to the naked eye, detection by hyperspectral imaging may be more efficient, safe, and cost effective. In addition, other physically observable changes may occur in the plats 14 subjected to contamination, such as stunted growth; however, it is believed that the pigmentation coloration is the easiest to identify, particularly remotely.

Turning back to FIG. 1, as the plants 14 grow in the soil 16, remote hyperspectral imaging may be used to determine which areas are contaminated by RDX 18 since only the prickly sida plants 14 in the contaminated areas 26 turn red and the prickly sida plants 14 in the uncontaminated areas 28 remain green. Because the plants 14 are able to detect the contaminants 18 beneath the surface of the soil 16 (through soil leaching and plant uptake), the movement pathways of the contaminants can be determined using the plants 14 at the surface.

Using plants 14 that grow in the natural range ecosystem to detect these contaminants is beneficial to military ranges as the plants 14 are relatively inexpensive. If additional plants 14 are needed on a range 16 they can be planted safely by air seeding or hydro seeding methods over an un-cleared range area. The use of vegetation as sentinels to indicate the presence and/or absence of contaminants may also provide an ideal mechanism for detecting contaminants in a large area. Additionally, forbs and grasses are commonly maintained on active firing ranges since they provide a realistic training environment and control erosion, so prickly sida plants 14 would look realistic in that environment.

Prickly sida 14 is also resilient to RDX contamination. Resilience to physical disturbance and tolerance towards contaminants such as energetics are important determinants in the distribution of plants 14 at contaminated training areas. Resilience is the ability of a vegetative system to recover after disturbance and return to its original state. Military training exercises often destroy the vegetation, which leads to soil erosion, increased runoff, and leaching of explosives. Since prickly sida 14 exhibits resilience to RDX 18, it is an ideal plant to be used to detect contamination by RDX 18.

Figure 2:
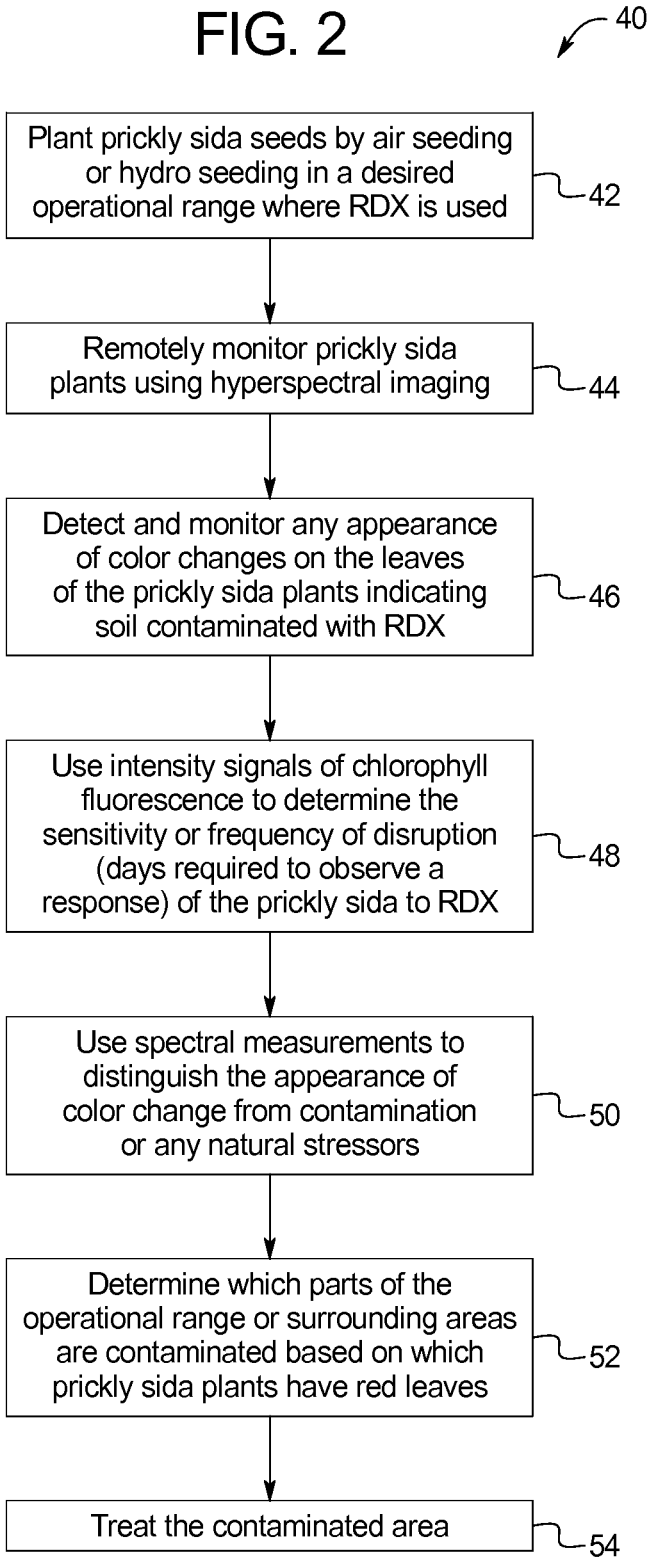
FIG. 2 is a flowchart illustrating an example of a method of using plant sentinels to detect soil contaminated with RDX.

FIG. 2 illustrates an example of a method 40 of using plant 14 sentinels to detect soil contaminated with RDX 18. In the first step 42, the prickly sida plants 14 are planted by air seeding or hydro seeding in a desired operational range or military site where RDX 18 is used. This allows for safe delivery of the plants 14 to the site. The second step 44 is to remotely monitor the prickly sida plants 14 using hyperspectral imaging. The use of remote sensing technology may lower costs of collecting sufficient data for comprehensive environmental assessment and may increase safety since data may not have to be collected by range personnel. Remote sensing technology is reliable and accurate. For example, remote sensing technology may also be used to distinguish between weeds and crops in a field with a high degree of accuracy.

The third step 46 is to detect and monitor any appearance of color changes on the leaves of the prickly sida plants 14 indicating soil contaminated with RDX 18. The fourth step 48 of the method 40 is to use intensity signals of chlorophyll fluorescence to determine the sensitivity of frequency disruption, or days required to observe a response, of the prickly sida plants 14 to RDX 18. These measurements are useful in assessing the plant's physiological state, which show a relationship to RDX exposure. The fifth step 50 is to use spectral measurements to distinguish the appearance of color changes from contamination or any natural stressors. It is helpful to discern that the color change is not caused by other environmental stressors. Stressors such as drought, soil salinity, pH changes, nutrients, and soil type may be evaluated to ensure they have not produced false positives.

The sixth step 52 of the method 40 is to determine which parts of the operational range or surrounding areas are contaminated based on which prickly sida 14 plants have red leaves. Once again, remote hyperspectral imaging is used to detect any red leaves on the prickly sida plants 14. This imaging may inform personnel of the exact location of the red prickly sida plants 14. Then finally, the seventh and final step 54 of the method 40 treat the contaminated area.

Figure 3A:
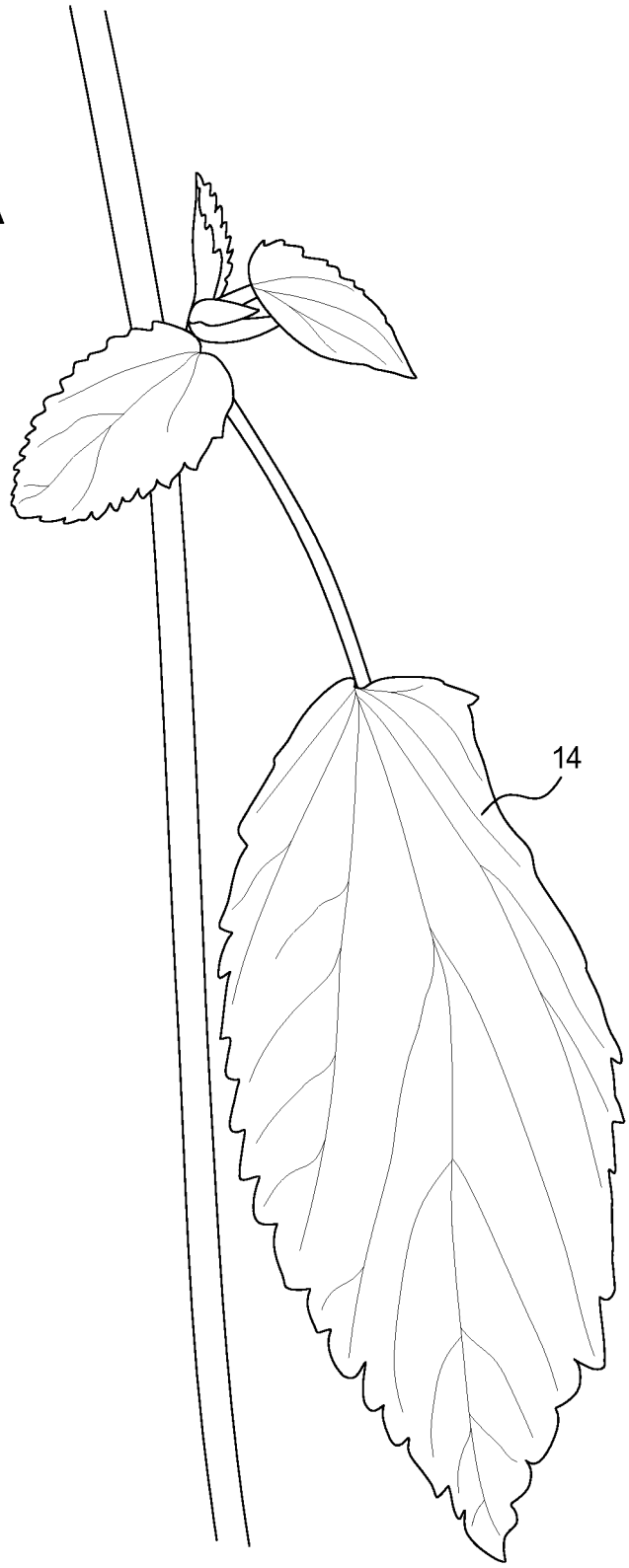
FIG. 3*a* is an example of a prickly sida plant that has not been exposed to RDX contamination.
Figure 3B:
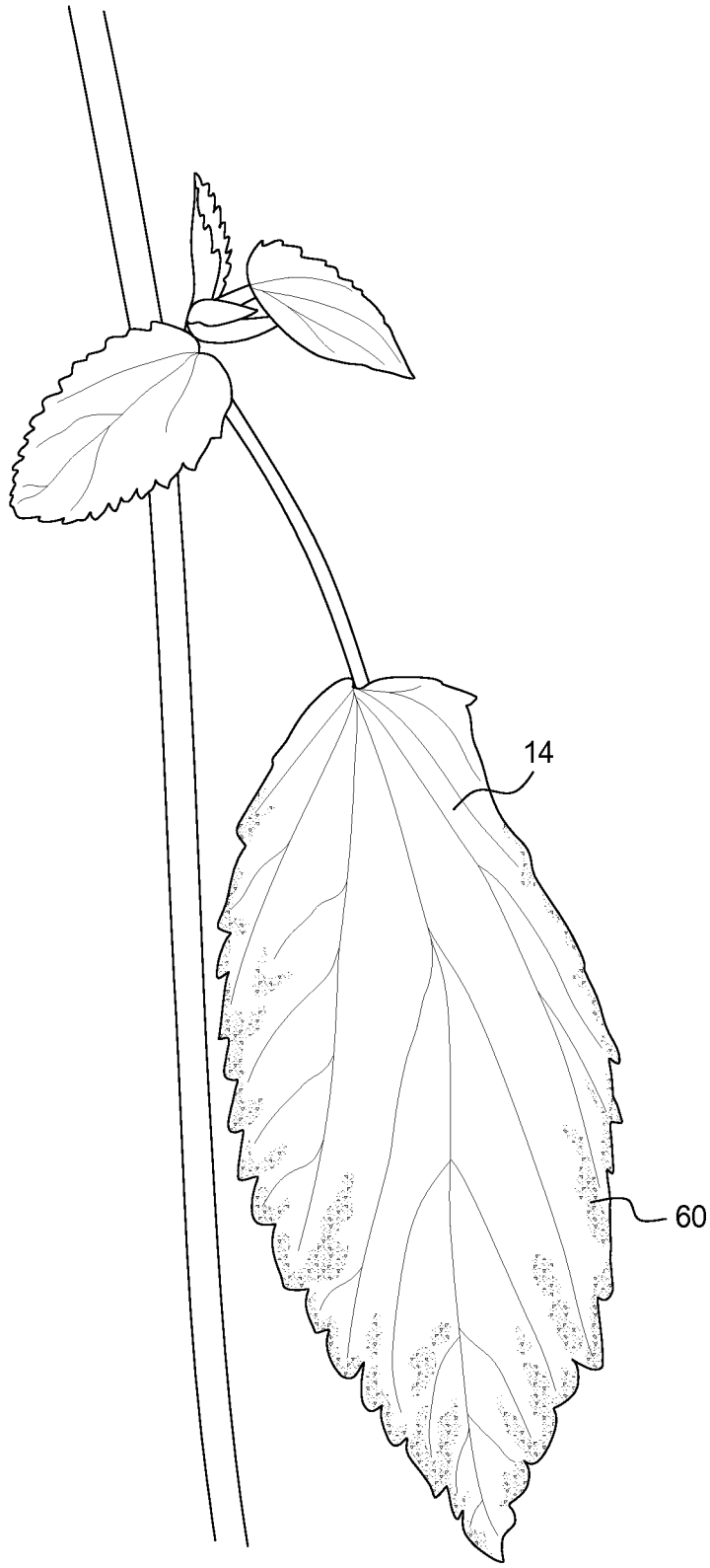
FIG. 3*b* is an example of a prickly sida plant that has detected RDX contamination.

FIG. 3A illustrates a prickly sida plant 14 that has not been exposed to RDX 18. FIG. 3B illustrates a prickly sida plant 14 that has been exposed to RDX 18. As shown in FIG. 3B, the prickly sida plant 14 that has been exposed to RDX 18 reacts by expressing a red pigmentation 60. As shown in FIG. 3, most changes to the pigmentation of the plants 14 occur on the leaves of the prickly sida plant 14, but the stem may also contain some red pigmentation 60 as well. In most cases, the red pigmentation 60 appears only on the top leaf surface and not the under leaf.

It should be noted that various changes and modifications to the presently preferred embodiments described herein will be apparent to those skilled in the art. Such changes and modifications may be made without departing from the spirit and scope of the present invention and without diminishing its attendant advantages.

I claim:

1. A method of detecting RDX in soil comprising the steps of:

planting a plurality of prickly sida plants in a defined area;

remotely monitoring the pigmentation of the prickly sida plants using hyperspectral imaging; and identifying one or more areas within the defined area that are contaminated by RDX based on the monitored pigmentation of the prickly sida plants.

2. The method of claim 1 wherein the step of planting the prickly sida plants is accomplished by an air seeding process.

3. The method of claim 1 wherein the step of plating the prickly sida plants is accomplished by a hydro seeding process.

4. The method of claim 1 wherein the step of remotely monitoring the pigmentation of the prickly sida plants includes monitoring the intensity signals of chlorophyll fluorescence in the plants.

5. The method of claim 1 wherein the step of remotely monitoring the pigmentation of the prickly sida plants includes using spectral measurements to distinguish the appearance of color changes in response to RDX as opposed to color changes in response to natural conditions.

6. The method of claim 1 further comprising the step of treating the identified contaminated areas to remove the RDX contamination.

* * * * *